US011286713B2

(12) United States Patent
Kim et al.

(10) Patent No.: US 11,286,713 B2
(45) Date of Patent: Mar. 29, 2022

(54) DOOR WITH FINGER PINCH PREVENTION FUNCTION

(71) Applicant: WOODS AIR CO., LTD., Busan (KR)

(72) Inventors: Seo Yeon Kim, Gimhae (KR); Hee Suk Kim, Gimhae (KR); Gang Suk An, Gimhae (KR); Dae Ii Kim, Gimhae (KR); Ji Won Kim, Gimhae (KR)

(73) Assignee: WOODS AIR CO., LTD., Busan (KR)

( * ) Notice: Subject to any disclaimer, the term of this patent is extended or adjusted under 35 U.S.C. 154(b) by 0 days.

(21) Appl. No.: 16/944,679

(22) Filed: Jul. 31, 2020

(65) Prior Publication Data

US 2021/0277709 A1 Sep. 9, 2021

(51) Int. Cl.
*E05D 11/00* (2006.01)
*E06B 7/36* (2006.01)

(52) U.S. Cl.
CPC ..... *E06B 7/367* (2013.01); *E05Y 2800/41* (2013.01)

(58) Field of Classification Search
CPC ..... E06B 7/367; E05Y 2800/41
USPC ..... 49/383, 384, 460, 504
See application file for complete search history.

(56) References Cited

U.S. PATENT DOCUMENTS 474,633 A * 5/1892 Glazier ..... E06B 7/367 49/383
1,101,960 A * 6/1914 Roberti ..... E06B 7/367 49/383
1,387,200 A * 8/1921 Smith ..... E06B 7/232 52/211
1,893,450 A * 1/1933 Shively ..... E05D 3/02 49/383
1,925,635 A * 9/1933 Hartley ..... E02D 29/1463 49/400
2,681,479 A * 6/1954 Dixon, Sr. ..... E06B 7/367 49/383
2,681,480 A * 6/1954 Dixon, Sr. ..... E06B 7/367 49/383
2,995,785 A * 8/1961 Hallenbeck ..... E06B 7/367 49/383
3,210,118 A * 10/1965 Chieger ..... B60J 5/108 296/106

(Continued)

FOREIGN PATENT DOCUMENTS

DE 2854122 A1 * 6/1980 ..... E06B 7/367
DE 3626924 A1 * 2/1988 ..... E06B 7/367

(Continued)

*Primary Examiner* — Jerry E Redman
(74) *Attorney, Agent, or Firm* — Patentfile, LLC; Bradley C. Fach; Steven R. Kick

(57) ABSTRACT

A door having a finger pinch prevention function is provided that can prevent a finger jamming accident between a door frame and a door by making sure that there is no gap between the door frame and the door coupled to one side of the door frame, in the process of opening and closing the door. The door has an effect of preventing a finger from being caught because a gap does not occur in a corner portion where the door and a coupling frame abut, even when the door is opened or closed, by combining the coupling frame coupled to one side of the door frame and the door through a hinge. Furthermore, by configuring a cover in the corner portion where the coupling frame and the door abut, the hinge is not exposed to the outside, so that the appearance can be seen appealing.

7 Claims, 13 Drawing Sheets

(56) References Cited

U.S. PATENT DOCUMENTS

| | | | | | |
|---|---|---|---|---|---|
| 4,878,267 | A * | 11/1989 | Roach | E06B 7/367 16/250 |
| 5,001,862 | A * | 3/1991 | Albenda | E06B 7/367 16/251 |
| 5,092,077 | A * | 3/1992 | Teinturier-Milgram | E06B 7/367 160/231.2 |
| 5,347,780 | A * | 9/1994 | Richards | C04B 28/14 52/204.1 |
| 5,570,917 | A * | 11/1996 | Cutrer | E05B 15/0205 16/392 |
| 5,581,948 | A * | 12/1996 | Simonsen | E05B 15/0205 16/388 |
| 5,782,283 | A * | 7/1998 | Kendall | E05D 15/24 160/229.1 |
| 6,679,004 | B1 * | 1/2004 | Olberding | E05B 15/0205 49/460 |
| 7,032,984 | B2 * | 4/2006 | Kim | G06F 1/1601 312/223.2 |
| 9,181,749 | B1 * | 11/2015 | Davis | E06B 7/367 |
| 2004/0107647 | A1 * | 6/2004 | Salzman | E06B 7/367 49/462 |
| 2005/0183342 | A1 * | 8/2005 | Holden | E06B 7/367 49/383 |
| 2010/0257788 | A1 * | 10/2010 | McRoskey | E06B 7/367 49/383 |
| 2015/0211291 | A1 * | 7/2015 | Jaffee | E06B 7/367 16/250 |

FOREIGN PATENT DOCUMENTS

| | | | | | |
|---|---|---|---|---|---|
| DE | 20120318 | U1 | | 4/2002 | |
| DE | 102011056056 | | | 1/2013 | |
| EP | 1605130 | A1 | * | 12/2005 | E06B 7/367 |
| EP | 3078801 | A4 | | 11/2017 | |
| FR | 2567565 | A1 | * | 1/1986 | E06B 5/11 |
| FR | 2937999 | A1 | * | 5/2010 | E06B 7/36 |
| GB | 2505720 | A | | 3/2014 | |
| JP | 2003184420 | A | | 7/2003 | |
| JP | 2009041317 | A | | 2/2009 | |
| JP | 3173647 | U | * | 2/2012 | E06B 7/367 |
| JP | 2016176293 | A | | 10/2016 | |
| JP | 2016191192 | A | | 11/2016 | |
| JP | 2018040135 | A | | 3/2018 | |
| KR | 20030073382 | A | | 9/2003 | |
| KR | 200409893 | Y1 | | 3/2006 | |
| KR | 101213121 | B1 | | 12/2012 | |
| KR | 101630135 | B1 | | 6/2016 | |
| KR | 101860537 | B1 | | 5/2018 | |
| KR | 101948131 | B1 | | 2/2019 | |
| WO | 2010008345 | A1 | | 1/2010 | |
| WO | WO-2011082133 | A2 | * | 7/2011 | E06B 7/367 |
| WO | WO-2013015542 | A1 | * | 1/2013 | E06B 7/367 |
| WO | WO-2018034572 | A1 | * | 2/2018 | E05D 3/02 |
| WO | 2020138838 | A1 | | 7/2020 | |

* cited by examiner

DOOR WITH FINGER PINCH PREVENTION FUNCTION

CROSS REFERENCE TO RELATED APPLICATIONS

This application claims priority to and the benefit of the filing date of Republic of Korea Application No. 10-2020-0029121, filed on 2020 Mar. 9, which is hereby incorporated by reference in its entirety.

TECHNICAL FIELD

The present disclosure relates to a door having a finger pinch prevention function. More particularly, the present disclosure relates to a door having a finger pinch prevention function that can prevent a finger jamming accident between a door frame and a door by making sure that there is no gap between the door frame and the door coupled to one side of the door frame in the process of opening and closing the door.

BACKGROUND ART

Generally, in the interior of a building, in the case of an office, a store, and a residential area, several rooms are formed, and a door is provided to form an independent space at the entrance of such a divided space, and most of these doors are formed by a hinge type.

Here, the hinge type door has a structure in which a door frame and a door are connected by hinges, and a gap between the door frame and the door connected by the hinges opens in the process of opening and closing the door. Therefore, if a finger or a hand is caught between these door gaps, a safety accident that incurs a serious injury will occur.

Due to this problem, a hinge type door structure for preventing fingers from being caught between the door frame and the door has been proposed, and the door structure of Patent Document 1 forms a cover between the door and the door frame, as shown in FIG. 1, thereby fundamentally preventing fingers from entering. According to this technique, a cover that can be extended to each of the door and the frame is attached, and the cover expands and contracts according to the opening and closing of the door to prevent the entry of fingers. This technique using the cover is common, but there is a disadvantage in that few people actually choose such a safety tool because the attachment is directly exposed to the exterior of the door and greatly damages the door design.

Meanwhile, a door structure to prevent a gap between a door frame and a door has been proposed, and in the door structure of Patent Document 2, as shown in FIG. 2, a safety door includes a door frame 200 which is installed in the doorway formed in a wall 100; an installation bar 10 having an inner space 11 in which an opening portion 12 is formed on one side inwardly at the door frame 200 and a hinge portion 13 for opening and closing a door 300 at upper and lower ends of the door frame; and a door 300 mounted with a hinge mounting bar 20 formed with a curved portion 30 which is mounted on one side end of the hinge portion 13 formed on the installation bar 10 and is not allowed to enter and exit the inner space 11 through the opening portion 12 such that interference does not occur; and is characterized in that a groove rim 21 is formed on one side of the hinge mounting bar 20, and the hinge mounting bar 20 is fixed to the door 300 by using a fixing means 40 to an inner bottom surface of the groove rim 21, and a curved portion 30 is formed with a fitting protrusion 32 that fits into the groove rim 21, so that the fitting protrusion is fitted into the groove rim 21 and is fixedly fixed by the fixing means 40 on one side of the hinge mounting bar 20 so as not to be separated in this state.

However, the door structure as described above is a structure formed by mounting the hinge portion 13 to the installation bar 10, and thus there is a problem in that the entire installation bar needs to be replaced when the hinge portion 13 needs be replaced due to damage. Furthermore, since a fastening member (bolt) which is used when the hinge portion 13 is coupled to the installation bar 10 is exposed to the outside, there is a problem that the appearance is not appealing.

DOCUMENTS OF PRIOR ART

Patent Document (PATENT DOCUMENT 0001) PATENT DOCUMENT 1: Domestic registration utility model 20-0409893 (registered on Feb. 21, 2006) Device of Preventing Hands to be Jammed in the Door for Gate (PATENT DOCUMENT 0002) PATENT DOCUMENT 2: Domestic registered patent publication 10-1630135 (Registered on Jul. 7, 2016) Appealing and easy-to-install safety door for preventing hand being caught therein

SUMMARY OF THE INVENTION

Therefore, the present disclosure is proposed to improve such a conventional problem, and the problem to be solved is to provide a door having a new type of finger pinch prevention function that prevents a gap between the door frame and the door and prevents a finger from being caught between the door frame and the door coupled to one side of the door frame.

Particularly, the problem to be solved is to provide a door having a function of preventing a finger from being caught because a gap does not occur in a corner portion where the door and a coupling frame abut, even when the door is opened or closed, by combining the coupling frame coupled to one side of the door frame and the door through hinges.

Furthermore, by configuring a cover in the corner portion where the coupling frame and the door abut, the problem to be solved is to provide a door having a finger pinch prevention function in which the hinges are not exposed to the outside so that the appearance can be seen appealingly.

According to a feature of the present invention for achieving the above object, a door with finger pinch prevention function includes a door frame 20 having a vertical frame 21 spaced apart from both sides and formed in a vertical direction, and a horizontal frame 22 coupled to the upper and lower portions of the vertical frame 21; a coupling frame 30 coupled to the inner side of the vertical frame 21 on one side of the door frame 20; a plurality of hinges 40 coupled to the upper and lower portions of the back side 31 of the coupling frame 30; a door 50 to which the other side of the hinges 40 is coupled to one lateral side 51; and characterized in that the coupling frame 30 and the door 50 are coupled by the hinges 40, so that even when the door 50 is opened and closed, a corner portion of the corner abutting the coupling frame 30 does not generate a gap.

In the door having the finger pinch prevention function according to the present disclosure as described above, it is characterized in that the vertical frame 21 of the door frame 20 has a projection portion 23 protruding toward the inner side of the front, the coupling frame 30 is coupled to the projection portion 23, and the door 50 is formed such that one lateral side 51 thereof faces the inner lateral side 24 of the vertical frame 21 when closed.

And in the door having a finger pinch prevention function according to the present disclosure, it is characterized in that the cross-section is made of a '└' shape and includes a cover frame 60 formed to cover the front side 32 and one lateral side 33 of the coupling frame 30.

Furthermore, in the door having a finger pinch prevention function according to the present disclosure, it is characterized in that the lateral side 61 of the cover frame 60 coupled to one lateral side 33 of the coupling frame 30 has a cutout portion 62 formed at a position corresponding to a plurality of the hinges 40 coupled to the upper and lower portions of the coupling frame 30.

In the door having the finger pinch prevention function according to the present disclosure, it is characterized in that the back side 31 of the coupling frame 30 is formed to be inclined from one side to the other.

And in the door having a finger pinch prevention function according to the present invention, it is characterized in that the door includes a wings portion 71 of which one side is coupled to the back side 31 of the coupling frame 30 and the other side is coupled to the lateral side 51 of the door 50, and an exposure prevention portion 72 that is formed between the wings portion 71 and prevent the hinges from being exposed to the outside.

Furthermore, in the door having a finger pinch prevention function according to the present invention, it is characterized in that the door includes a back cover 80 of which one side is coupled to one lateral side 51 of the door 50, the other side is formed to abut the inner lateral side 24 of the vertical frame 21 of the door frame 20, and a space between the inner lateral side 24 of the vertical frame 21 of the door frame 20 and the door 50 is not exposed to the outside.

According to the door having a finger pinch prevention function according to the present disclosure as described above, there is an effect of preventing a finger jamming accident between the door frame and the door by making sure that there is no gap between the door frame and the door coupled to one side of the door frame in the process of opening and closing the door.

Particularly, the door has an effect of preventing a finger from being caught because a gap does not occur in a corner portion where the door and the coupling frame abut, even when the door is opened or closed, by combining the coupling frame coupled to one side of the door frame and the door through the hinges.

Furthermore, by configuring the cover in the corner portion where the coupling frame and the door abut, the hinges are not exposed to the outside, so that the appearance can be seen appealingly.

DETAILED DESCRIPTION OF PREFERRED EMBODIMENTS

Figure 1:
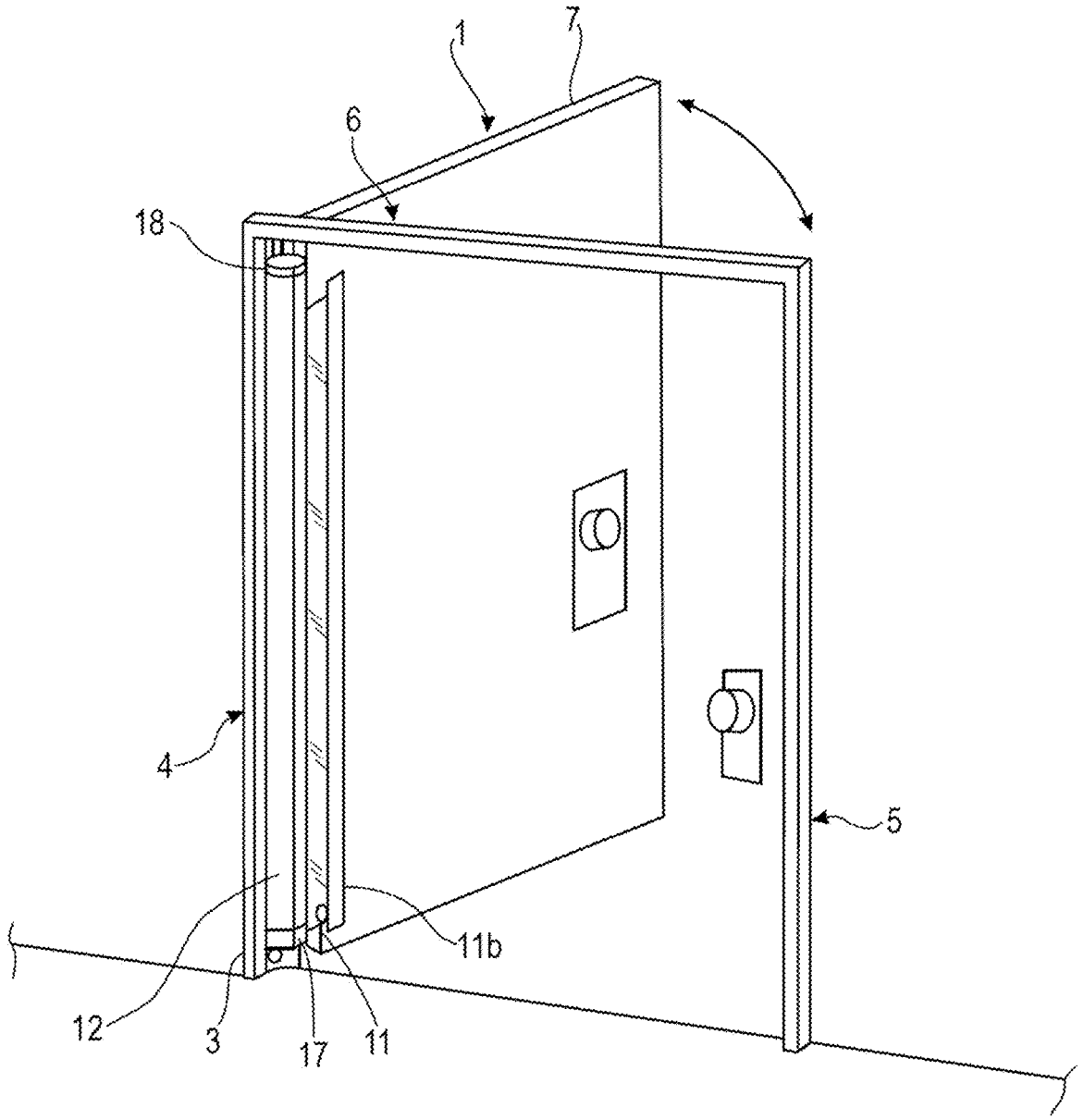
PRIOR ART FIG. 1
FIGS. 1 and 2 are views for showing the prior art.
Figure 2:
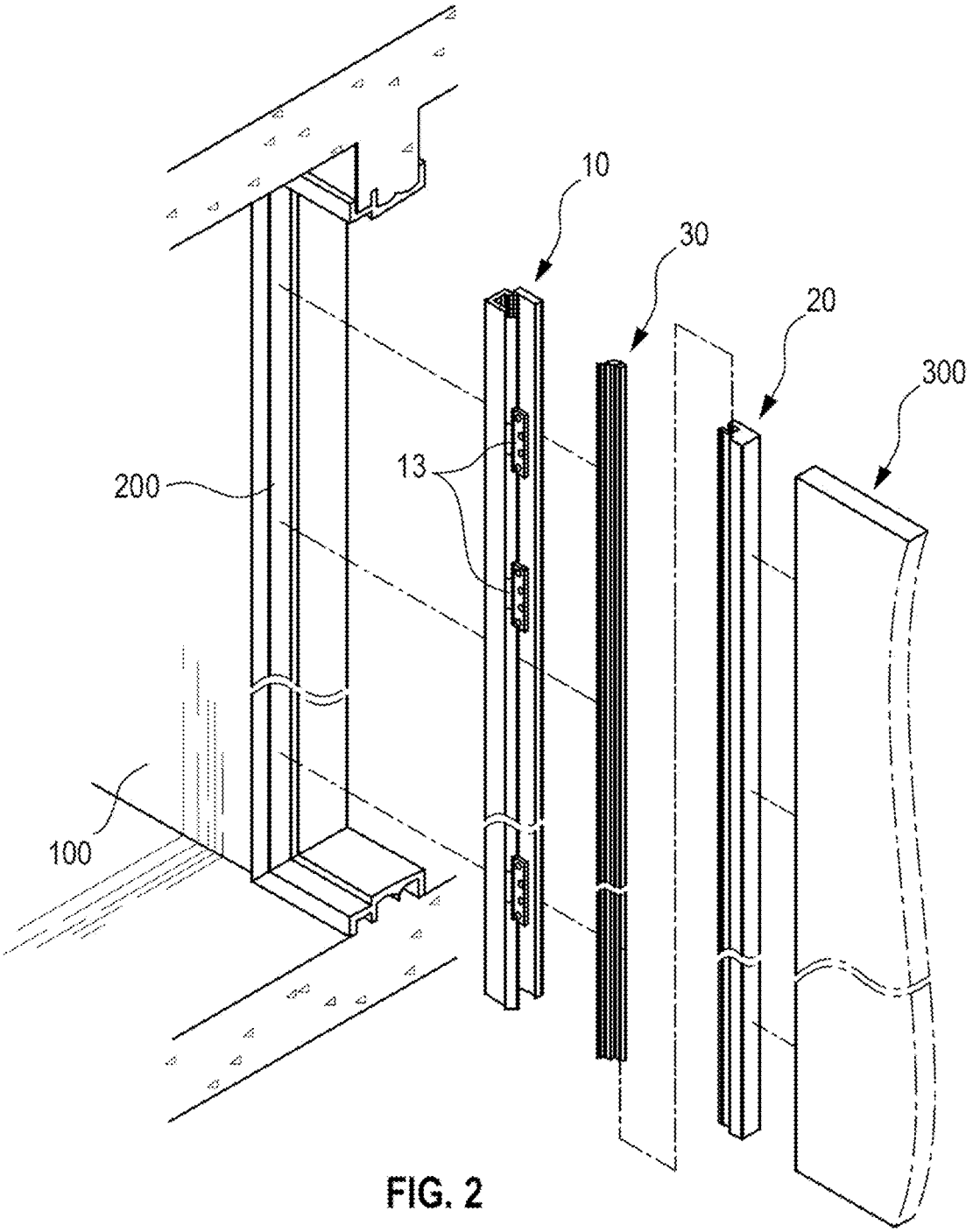
FIG. 2 PRIOR ART
Figure 3:
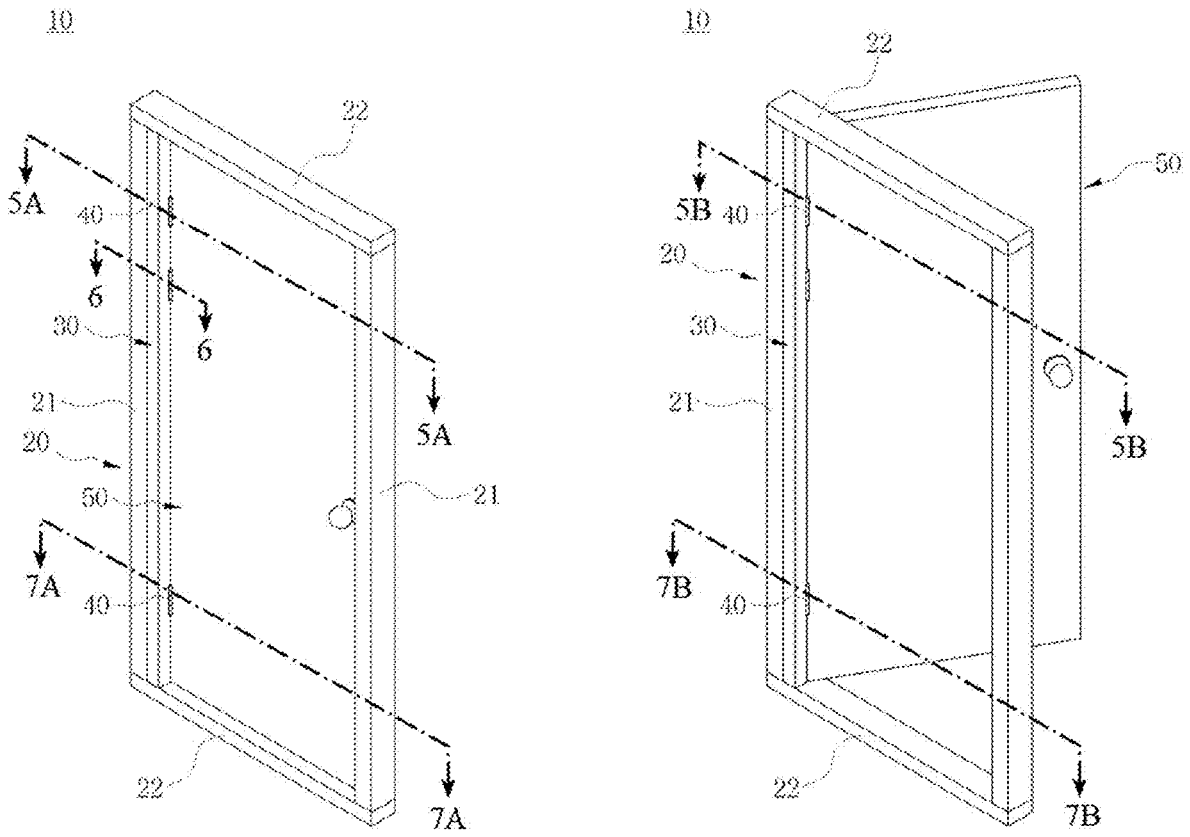
FIG. 3 is a perspective view of a door having a finger pinch prevention function according to a preferred embodiment of the present disclosure.
Figure 4A:
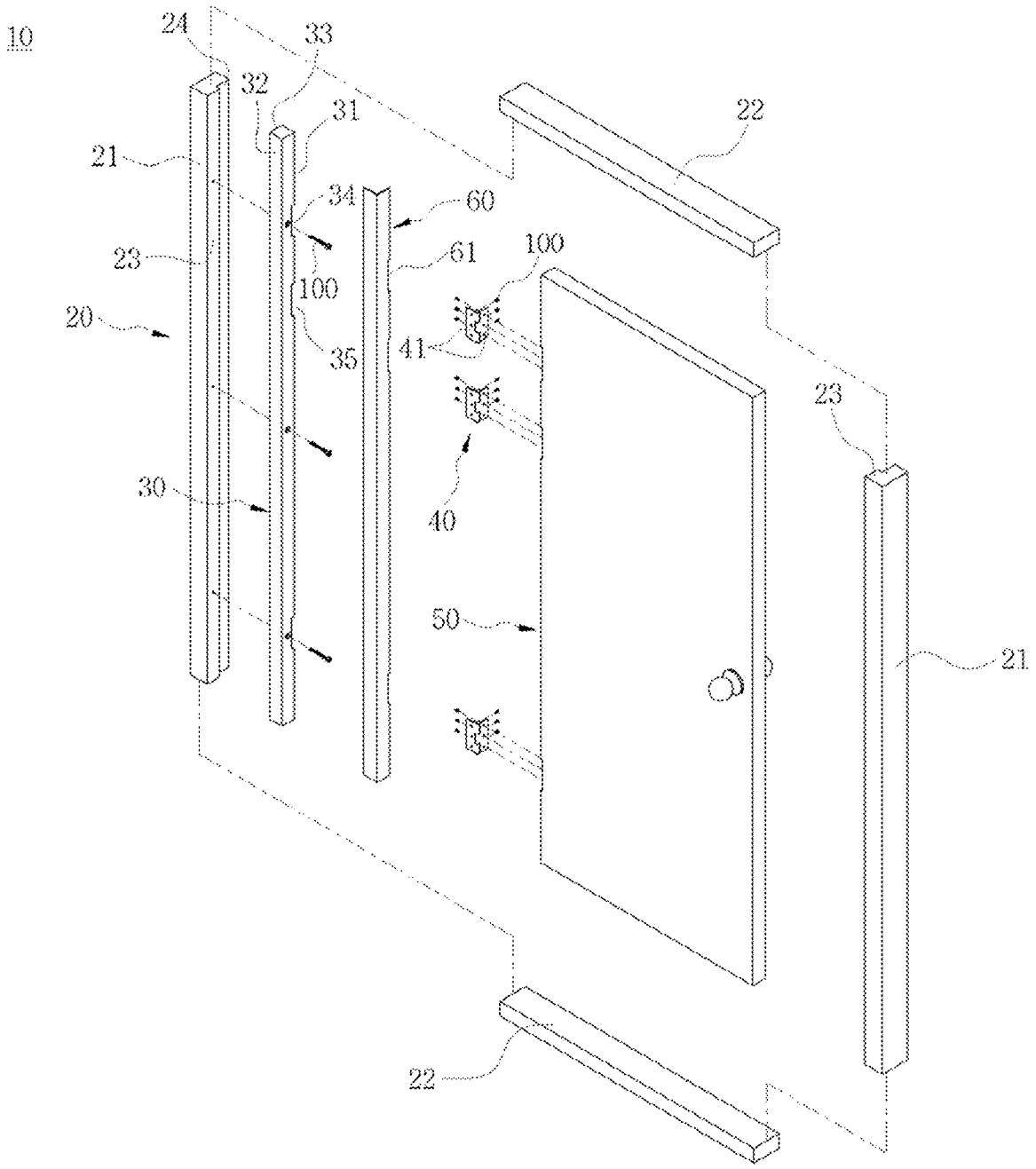
FIG. 4A and FIG. 4B are exploded perspective views of a door having a finger pinch prevention function according to a preferred embodiment of the present disclosure.
Figure 4B:
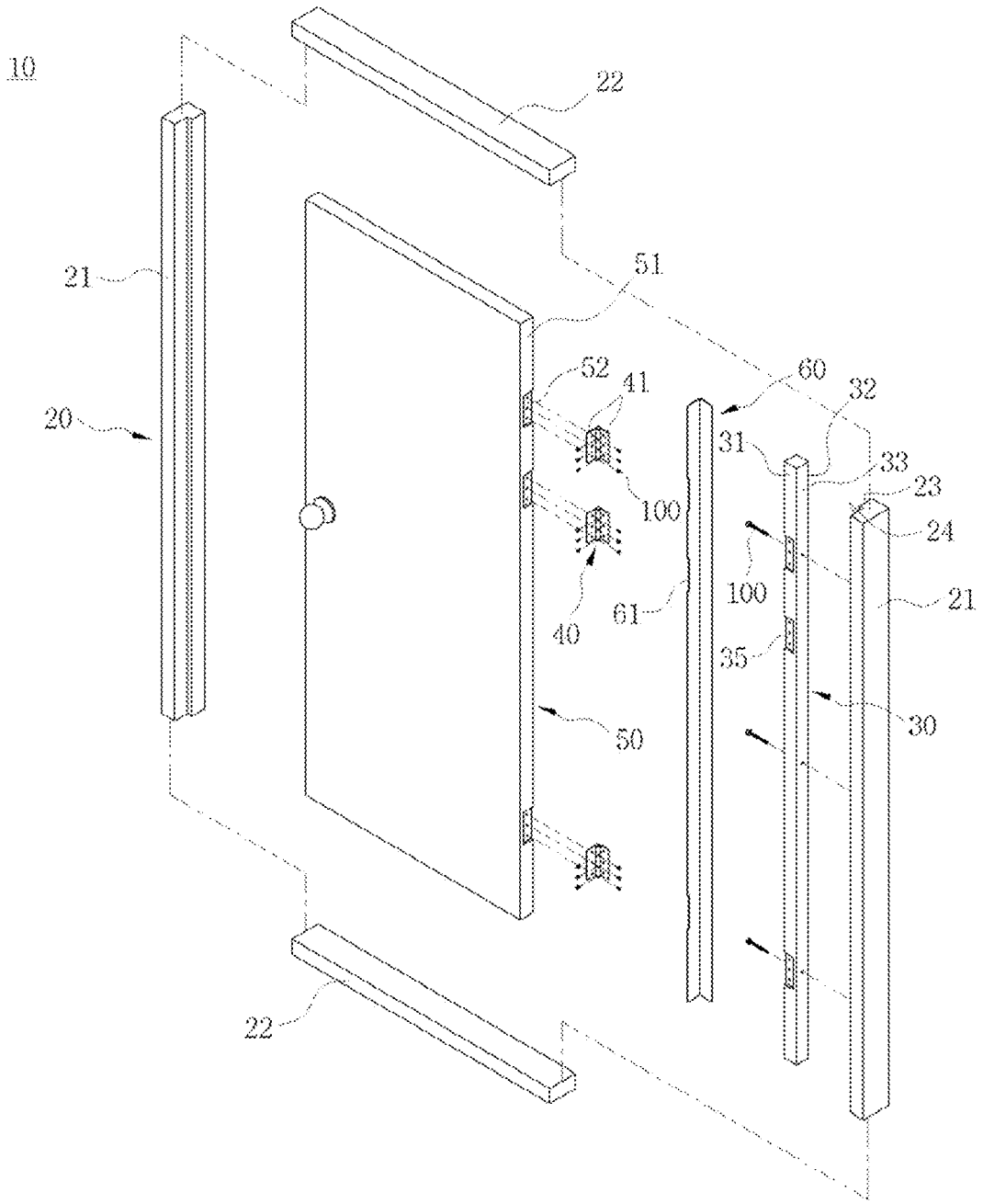
Figure 5A:
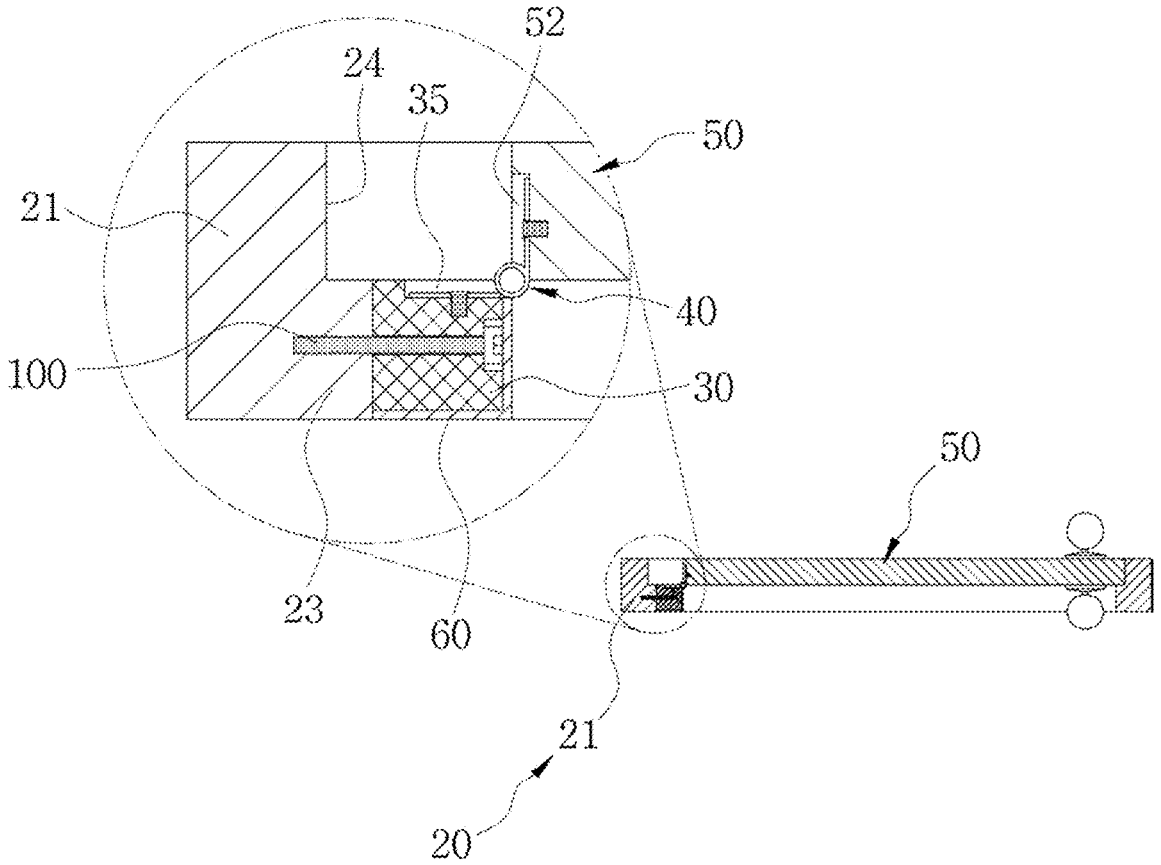
FIG. 5A is a cross-sectional view of a door closed and the door having a finger pinch prevention function according to a preferred embodiment of the present disclosure.
Figure 5B:
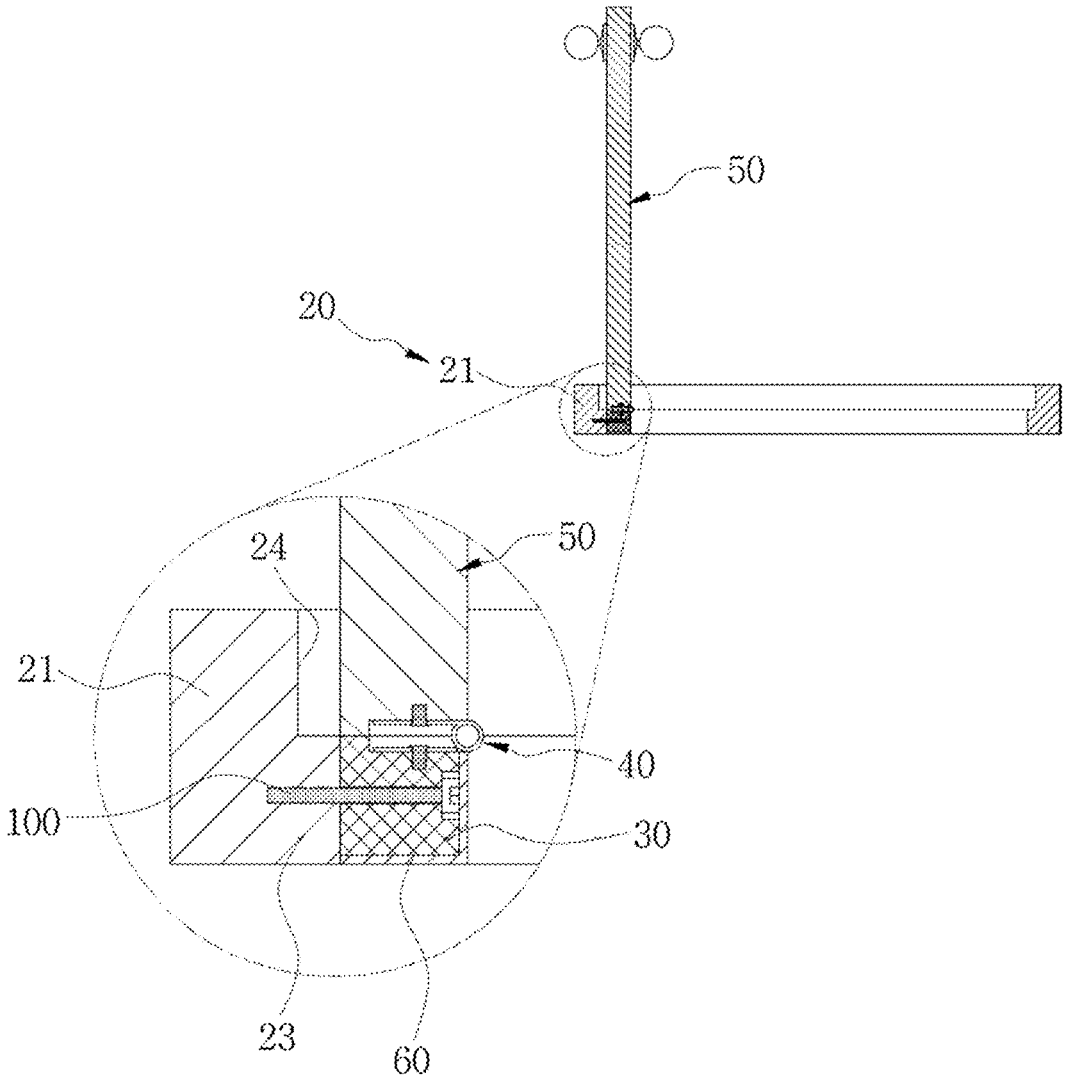
FIG. 5B is a cross-sectional view of a door opened and the door having a finger pinch prevention function according to a preferred embodiment of the present disclosure.

Hereinafter, preferred embodiments of the present disclosure will be described in detail with reference to the accompanying drawings, and the same reference numerals are used for elements that perform the same functions in FIGS. 3 to 9B. Meanwhile, in the illustration and detailed description of the drawings, detailed descriptions and illustrations of elements that are not directly related to the technical features of the present disclosure are omitted, and only the technical configurations related to the present disclosure are briefly shown or explained.

Meanwhile, in the description of the preferred embodiment of the present disclosure, the front side 50 refers to the front direction side of the door 50, the back side refers to the back direction side of the door 50, and the lateral side refers to both side-direction sides of the door 50 and it will be known that this is a general direction.

Referring to FIGS. 3 to 9B, the door 10 having finger pinch prevention function according to a preferred embodiment of the present disclosure include; a door frame 20 having a vertical frame 21 spaced apart from both sides and formed in a vertical direction, and a horizontal frame 22 coupled to the upper and lower portions of the vertical frame 21; a coupling frame 30 coupled to the inner side of the vertical frame 21 on one side of the door frame 20; a plurality of hinges 40 coupled to upper and lower portions of the back side 31 of the coupling frame 30; and a door 50 to which the other side of the hinges 40 is coupled to one lateral side 51; characterized in that the coupling frame 30 and the door 50 are coupled by the hinges 40, so that even when the door 50 is opened and closed, a corner portion of the corner contacting the coupling frame 30 does not generate a gap.

The door frame 20 is coupled to a wall and corresponds to a frame for supporting all elements, and consists of the vertical frame 21 and the horizontal frame 22 in a rectangular frame shape.

The vertical frame 21 is formed to face each other in a plate shape, and a projection portion 23 is formed in the vertical direction on the front side. That is, it is formed in a '└' shape so that the projection portion 23 is formed inner side to face each other. The horizontal frame 22 is coupled to the upper and lower portions of the vertical frame 21 in a plate shape. In the preferred embodiment of the present disclosure, the horizontal frame 22 is formed to be coupled to the upper and lower portions of the vertical frame 21, but can be coupled only to the upper portion.

The coupling frame 30 has a rectangular cross section and is coupled to the projection portion 23 of the vertical frame 21 of the door frame 20. At this time, it is coupled to the projection portion 23 of the vertical frame 21 on one side thereof, but is coupled to the inner side of the protrusion 23, that is, to the direction facing each other.

In the coupling frame 40, a coupling hole 34 is formed so that bolts 100 penetrate through the upper and lower portions of the lateral side 33 thereof to be coupled to the vertical frame 21 of the door frame 20, and a coupling groove 35 is formed on the upper and lower portions so that the hinge piece 41 of the hinge 40 is coupled to the back side 31 by the bolts 100.

In the preferred embodiment of the present disclosure, the coupling frame 30 is configured to be coupled to the vertical frame 21 by the bolts 100 when coupled to the vertical frame 21 of the door frame 20, but this is only an embodiment and may be coupled through various coupling means, including bolts and adhesives.

Figure 7A:
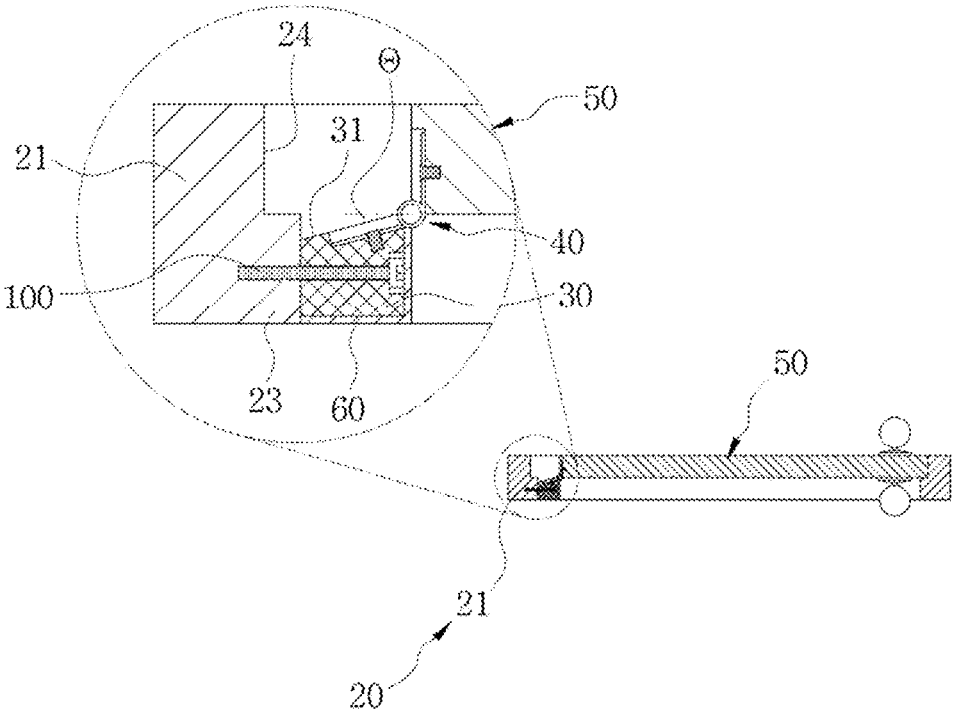
FIGS. 7A and 7B are views showing that the back side of a coupling frame is formed in an inclined position in a door having a finger pinch prevention function according to a preferred embodiment of the present disclosure.
Figure 7B:
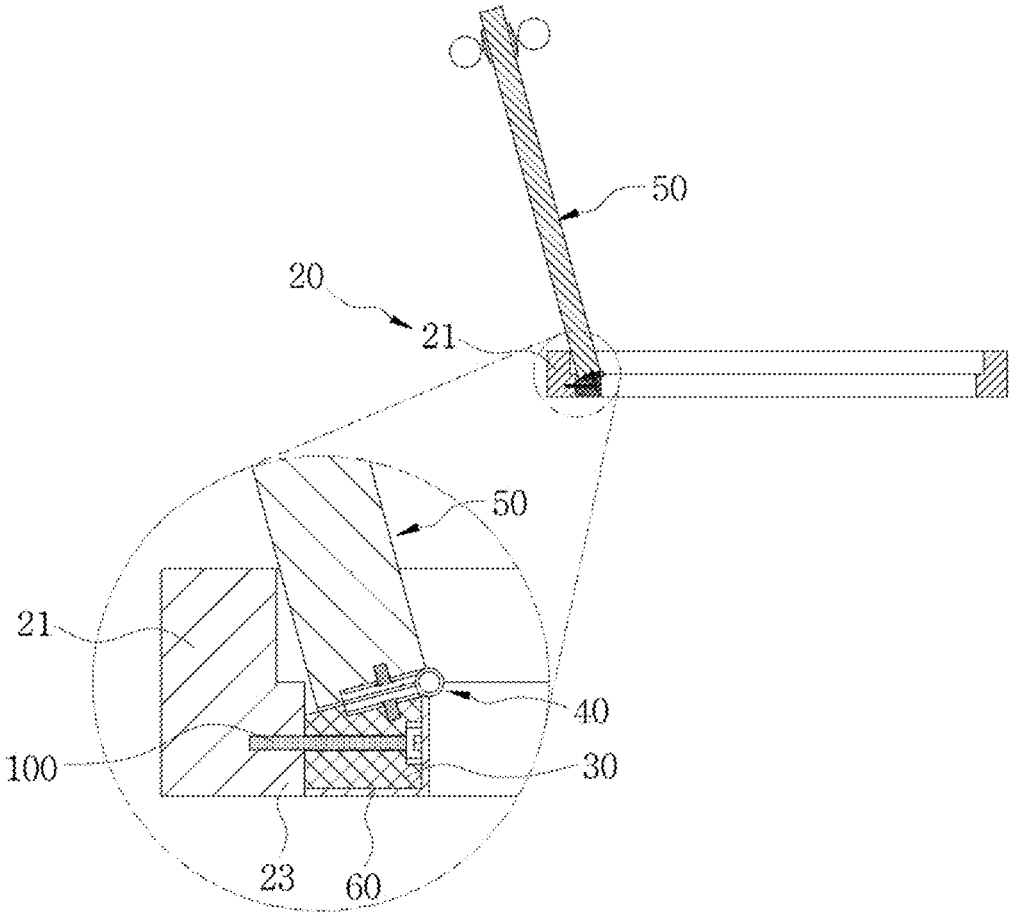

Meanwhile, the coupling frame 30 is formed such that the back side 31 is inclined from one side to the other side as shown in FIGS. 7A and 7B. Here, the inclined direction is formed such that the width in the direction of the vertical frame 21 of the door frame 20 becomes narrower than the width in the direction of the door 50. At this time, the inclination angle 'θ' is preferably 20°, but may be formed in various ways as required.

By forming the back side 31 of the coupling frame 30 to be inclined in this way, when the door 50 is opened, one side of the door 50 hits the back side 31 of the coupling frame 30. Therefore, there is an effect that can be prevented from being injured by a user entering and exiting the door 50 by returning to the front side by recoil.

Meanwhile, the cover frame 60 having a '└' shaped cross-sectional shape is coupled to the front side 32 and one lateral side 33 of the coupling frame 30. The cover frame 60 is intended to make the appearance appealing so that the bolt 100 used when the coupling frame is coupled to the vertical frame is not exposed to the outside. The lateral side 61 of the cover frame 60 has cutout portions 62 formed at positions corresponding to a plurality of hinges 40 coupled to the upper and lower portions of the coupling frame 30.

The hinges 40 have one side to be coupled to the coupling frame 30 and the other side to be coupled to the door 50 such that the door 50 is rotatable. The hinges 40 are made by including hinge pieces 41 to be bolted to the coupling groove 35, 52 formed in the coupling frame 30 and the door 50. The hinges 40 are composed of a plurality, and are coupled to the upper and lower portions of the coupling frame 30 and the door 50.

The door 50 is rotatably coupled to the hinges 40, a coupling groove 52 is formed such that the hinge piece 41 of the hinge 40 is coupled to one lateral side 51. At this time, the coupling groove 52 is formed on the upper and lower portions to correspond to the position and number of the hinges 40.

Figure 6:
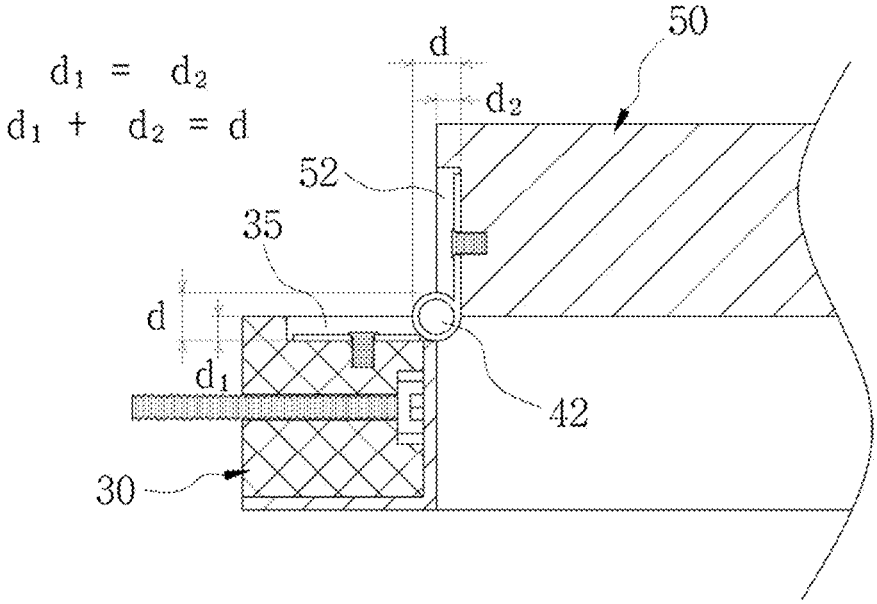
FIG. 6 is a view showing a hinge installed on a coupling frame and a door in the door having a finger pinch prevention function according to a preferred embodiment of the present disclosure.

Meanwhile, the depth $d_1$ of the coupling groove 35 of the coupling frame 30 and the depth $d_2$ of the coupling groove 52 of the door 50 are, as shown in FIG. 6, are formed by half the thickness of the rotating shaft 42 of the hinges 40, and one-quarter of the rotating shaft 42 of the hinges positioned at the corner portion of the coupling frame 30 and the door 50 is formed to protrude to the front side. For example, if the thickness of the rotating shaft 42 of the hinges 40 is 12 mm, the depth of the coupling groove 35 of the coupling frame 30 and the depth of the coupling groove 52 of the door 50 are formed to 6 mm. In this way, forming the depth of the coupling groove 35 of the coupling frame 30 and the coupling groove 35 of the door 50 in half is to enable the door 50 to rotate smoothly without being caught during rotation.

According to the door 10 having the finger pinch prevention function according to the present disclosure as described above, there is an effect of preventing a finger jamming accident between the door frame 20 and the door 50 by making sure that there is no gap between the door frame 20 and the door 50 coupled to one side of the door frame 20 in the process of opening and closing the door 50.

Particularly, by coupling the coupling frame 30 which is coupled to one side of the door frame 20 and the door 50 through the hinges 40, even when the door is opened or closed, there is no gap in the corner portion where the door 50 and the coupling frame 30 come in contact with each other, thereby preventing a finger from being caught.

Figure 8A:
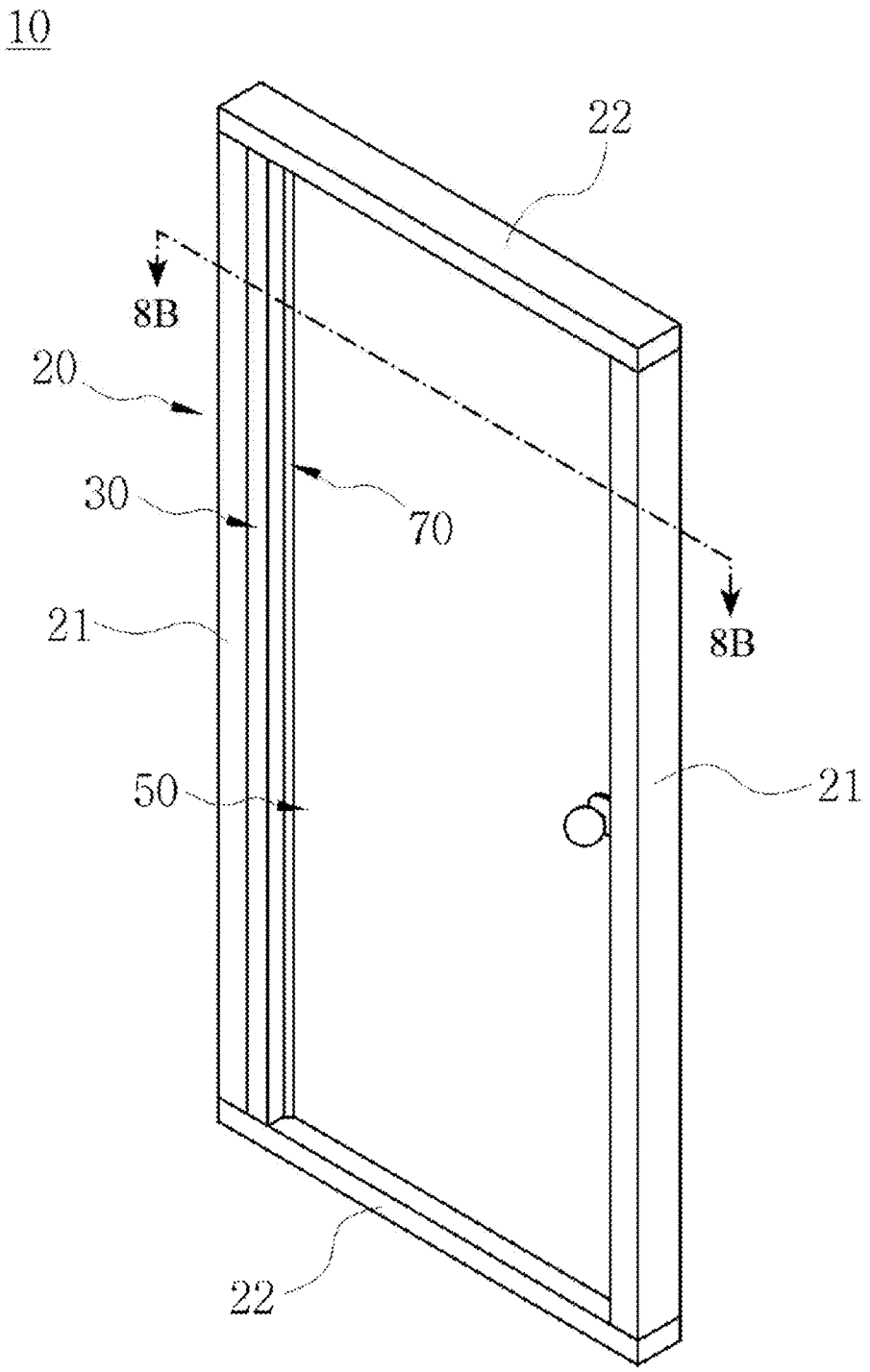
FIGS. 8A and 8B are views showing a cover installed in a door having a finger pinch prevention function according to a preferred embodiment of the present disclosure.
Figure 8B:
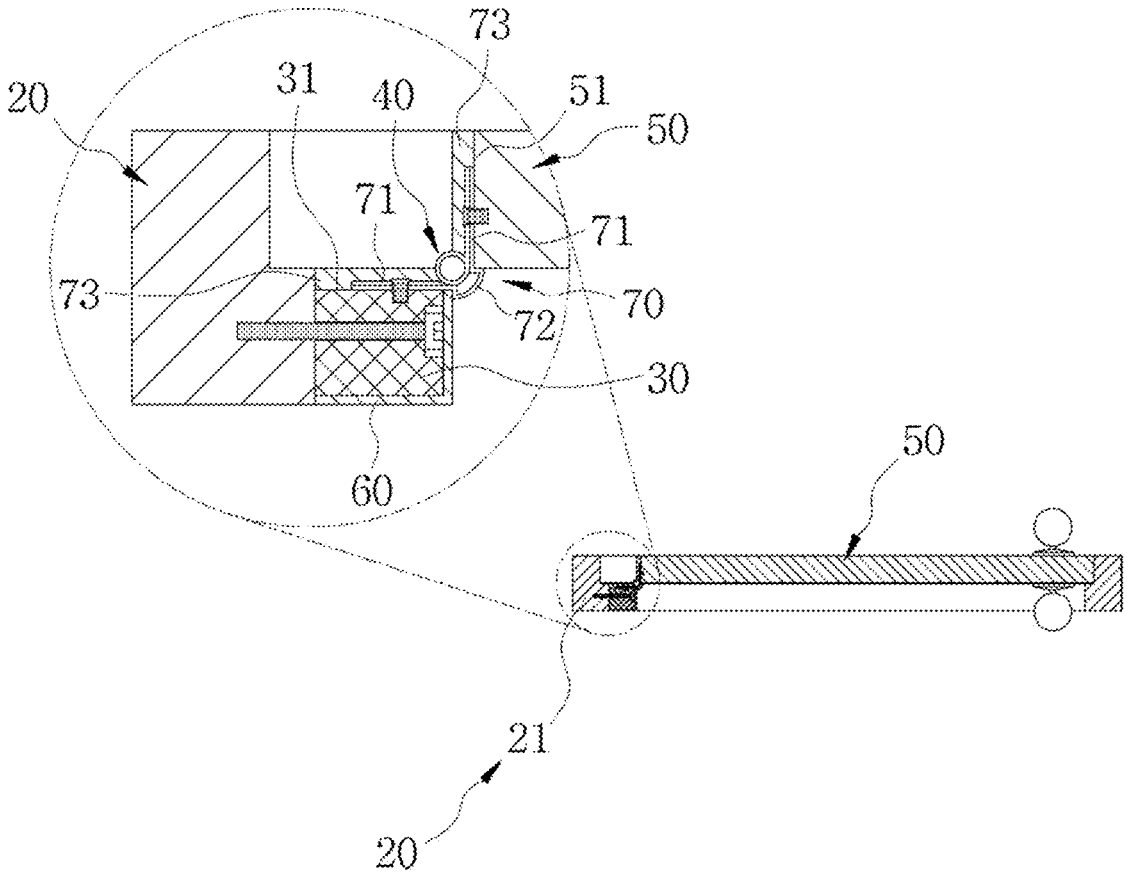

Meanwhile, the door 10 having a finger pinch prevention function according to a preferred embodiment of the present disclosure includes a cover 70 to prevent the hinges 40 from being exposed to the outside as shown in FIGS. 8A and 8B. The cover 70 is made of a soft synthetic resin material, and includes a wings portion 71 of which one side is coupled to the back side 31 of the coupling frame 30 and the other side is coupled to the lateral side 51 of the door 50, and an exposure prevention portion 72 that is formed between the wings portion 71 and prevent the hinges 40 from being exposed to the outside.

Meanwhile, when the cover 70 is coupled to the coupling frame 30 and the door 50, it is preferable not to form coupling grooves 35, 52 for coupling the hinges 40, and accordingly, the coupling frame 30 and the door 50 are formed to have a smaller cross-sectional area as much as the depth of the coupling grooves 35, 52.

When the cover 70 is coupled, the wings portion 71 is positioned on the back side 31 of the coupling frame 30 and the lateral side of the door 50, and the hinge piece 41 of the hinges 40 gets in close contact with the wings portion 71 to be coupled to the coupling frame 30 and the door 50 by the bolts 100. At this time, a gap corresponding to the thickness of the rotating shaft 42 of the hinges 40 is generated in the corner portion of the coupling frame 30 and the door 50. In order to block this, finishing frames 73 are coupled to the back side 31 of the coupling frame 30 and one lateral side 51 of the door 50 in a vertical direction.

By configuring in this way, on the front side the hinges 40 are not seen by the cover 70 and a gap is not generated at the same time, thereby preventing the fingers from being caught and the appearance being appealing, and on the back side the pinching of the fingers is prevented by the finishing frames 73 and the appearance is appealing. Furthermore, if the handle portion closes to the door frame 20 when the door 50 is closed, the door 50 is temporarily stopped by the cover 70, thereby preventing the finger from being caught between the handle portion of the door 50 and the door frame 20.

Figure 9A:
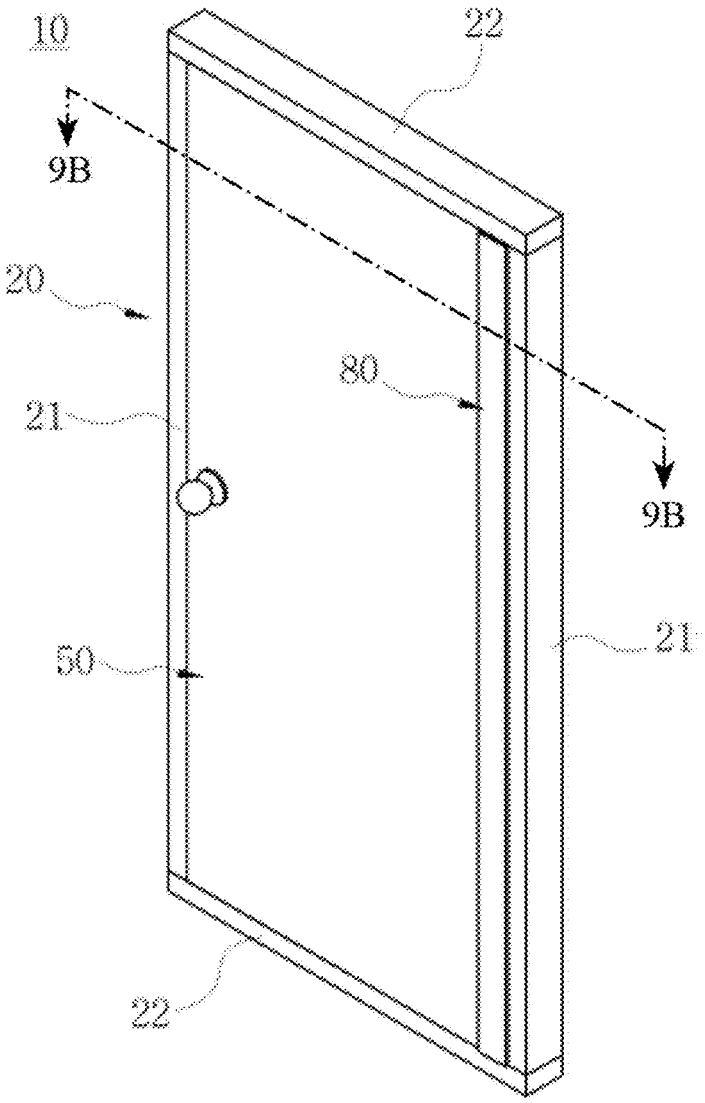
FIGS. 9A and 9B are views showing a back cover installed in a door having a finger pinch prevention function according to a preferred embodiment of the present disclosure.
Figure 9B:
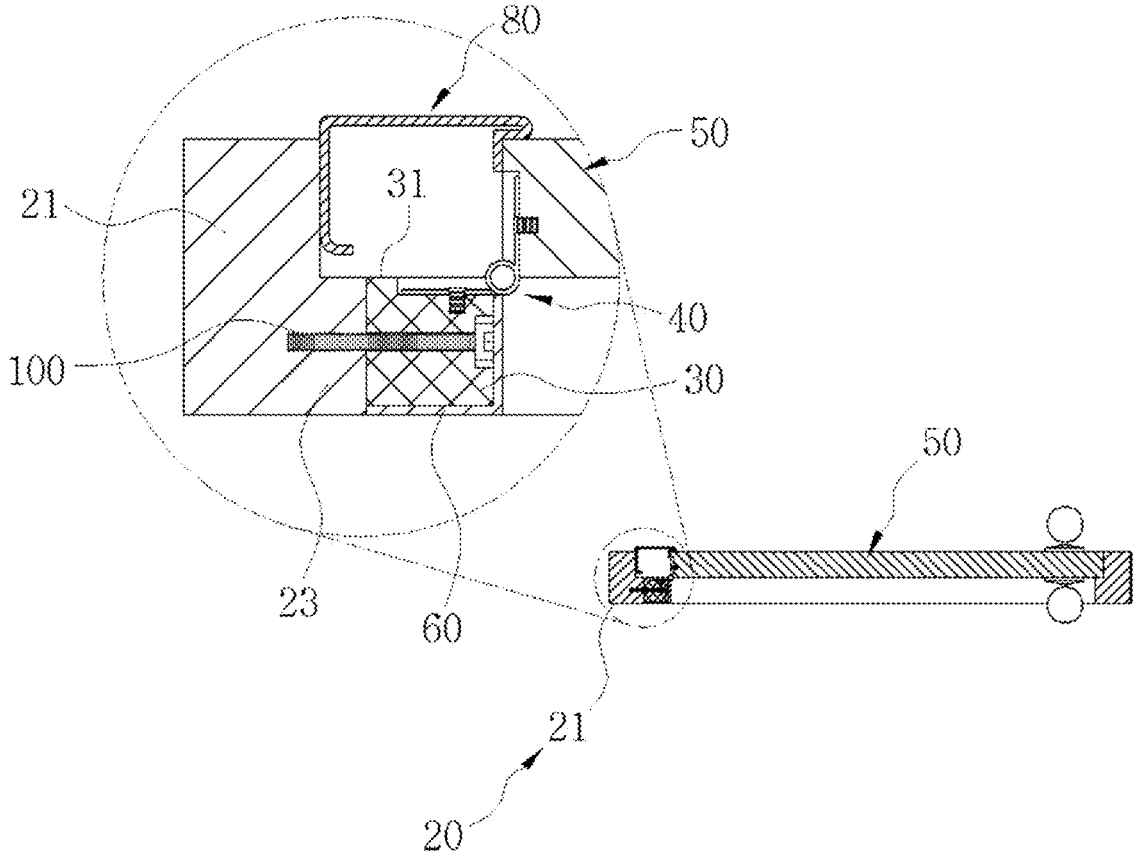

And the door 10 having a finger pinch prevention function according to a preferred embodiment of the present disclosure includes a back cover 80 to prevent the back side 31 of the coupling frame 30 from being exposed to the outside as shown in FIGS. 9A and 9B. In the back cover 80, one side thereof is coupled to one lateral side of the door 50, the other side thereof is formed to abut the inner lateral side 24 of the vertical frame 21 of the door frame 20, and a space between the inner lateral side 24 of the vertical frame of the door frame 20 and the door 50 is not exposed to the outside. At this time, in the back cover 80, one side thereof is coupled to one lateral side 51 of the door 50 using an adhesive or the like, and the other side thereof is formed to be movable when the door is opened or closed by abutting the inner lateral side 24 of the vertical frame 21 of the door frame 20.

As described above, the cover 70 is configured at the corner where the coupling frame 30 and the door 50 abut, and the back cover 80 is configured at the back side 31 such that the hinges 40 are not exposed to the outside on the front side, and the back side 31 of the coupling frame 30 is not exposed on the rear side, so that the appearance can be seen appealingly.

As described above, the door having the finger pinch prevention function according to the preferred embodiment of the present disclosure is illustrated according to the above description and drawings, but this is merely an example and those skilled in the art will understand that various changes and modifications are possible without departing from the technical idea of the present disclosure.

LIST OF REFERENCE NUMBERS

| | | | |
|---|---|---|---|
| 10: | DOOR WITH FINGER PINCH PREVENTION FUNCTION | | |
| 20: | DOOR FRAME | 21: | VERTICAL FRAME |
| 22: | HORIZONTAL FRAME | 23: | PROJECTION PORTION |
| 24: | INNER LATERAL SIDE | 30: | COUPLING FRAME |
| 31: | BACK SIDE | 32: | FRONT SIDE |
| 33: | LATERAL SIDE | 40: | HINGE |
| 50: | DOOR | 51: | LATERAL SIDE |
| 60: | COVER FRAME | 61: | LATERAL SIDE |
| 62: | CUTOUT PORTION | 70: | COVER |
| 71: | WINGS PORTION | 72: | EXPOSURE PREVENTION PORTION |
| 80: | BACK COVER | | |

The invention claimed is:

1. A door with finger pinch prevention function, comprising:

a door frame 20 having a vertical frame 21 with two sides spaced apart and formed in a vertical direction, and two horizontal frames 22 coupled to an upper and lower portions of the vertical frame 21;

a coupling frame 30 coupled to an inner side of the vertical frame 21 on one side of the door frame 20;

a first coupling groove 35 formed in the coupling frame 30, the first coupling groove 35 having a depth (d1);

a plurality of hinges 40 coupled to the upper and lower portions of a back side 31 of the coupling frame 30, wherein a hinge 40 of the plurality of hinges 40 includes a rotating shaft 42 having a thickness (d); and a door 50 to which the hinges 40 are coupled to one lateral side 51, the lateral side 51 having a second coupling groove 52, the second coupling groove 52 having a depth (d2), wherein the first coupling groove 35 depth (d1) and the second coupling groove 52 depth (d2) are each half the thickness (d) of the rotating shaft 42, and wherein one quarter of the rotating shaft 42 of the hinge 40 of the plurality of hinges 40 is positioned at a corner portion of the coupling frame 30 and the door 50 is formed to protrude to a front side 32 of the coupling frame 30, and characterized in that the coupling frame 30 and the door 50 are coupled by the hinges 40, such that even when the door 50 is opened and closed, the corner portion abutting the coupling frame 30 does not generate a gap.

2. The door with finger pinch prevention function according to claim 1, wherein the vertical frame 21 of the door frame 20 has a projection portion 23 inwardly protruding, the coupling frame 30 is coupled to the projection portion 23, and when the door 50 is closed, one lateral side 51 thereof is formed to face an inner lateral side 24 of the vertical frame 21.

3. The door with finger pinch prevention function according to claim 2, wherein the door with finger pinch prevention function comprises a back cover 80 which is coupled to one lateral side 51 of the door 50, and is formed to abut the inner lateral side 24 of the vertical frame 21 of the door frame 20, and space between the inner lateral side 24 of the vertical frame 21 of the door frame 20 and the door 50 is not exposed to the outside.

4. The door with finger pinch prevention function according to claim 1, wherein the door with finger pinch prevention function comprises a cover frame 60 having a cross-section of an L shape and formed to cover a front side 32 and one lateral side 33 of the coupling frame 30.

5. The door with finger pinch prevention function according to claim 4, wherein the lateral side 61 of the cover frame 60 coupled to one lateral side 33 of the coupling frame 30 is formed with a cutout portion 62 formed at a position corresponding to a plurality of the hinges 40 coupled to the upper and lower portions of the coupling frame 30.

6. The door with finger pinch prevention function according to claim 1, wherein the back side 31 of the coupling frame 30 is formed to be inclined from one side to the other.

7. The door with finger pinch prevention function according to claim 1, wherein the door with finger pinch prevention function comprises a cover 70 that has a wings portion 71 which is coupled to both the back side 31 of the coupling frame 30 and lateral side 51 of the coupling frame 30; and an exposure prevention portion 72 that is formed between the wings portion 71 and prevent the hinges 40 from being exposed to the outside.

* * * * *